US005647439A

United States Patent [19]

Burdick et al.

[11] Patent Number: 5,647,439

[45] Date of Patent: Jul. 15, 1997

[54] IMPLEMENT CONTROL SYSTEM FOR LOCATING A SURFACE INTERFACE AND REMOVING A LAYER OF MATERIAL

[75] Inventors: J. Scott Burdick, Pekin; Paul T. Corcoran, Washington; Adam J. Gudat, Edelstein; Robert A. Herold; John F. Szentes, both of Peoria, all of Ill.

[73] Assignee: Caterpillar Inc., Peoria, Ill.

[21] Appl. No.: 572,136

[22] Filed: Dec. 14, 1995

[51] Int. Cl.[6] ..... E02F 3/76

[52] U.S. Cl. ..... 172/4.5; 364/424.07; 342/22; 37/382

[58] Field of Search ..... 172/4.5, 4, 2; 37/414, 37/382, 348; 342/22, 129, 194; 364/424.07, 420

[56] References Cited

U.S. PATENT DOCUMENTS

| | | | |
|---|---|---|---|
| 4,200,787 | 4/1980 | Carson | 250/227 |
| 4,213,503 | 7/1980 | Elmberg et al. | 172/4.5 |
| 4,413,684 | 11/1983 | Duncklee | 172/4.5 |
| 4,431,060 | 2/1984 | Scholl et al. | 172/2 |
| 4,676,695 | 6/1987 | Duthweiler | 405/157 |
| 4,733,355 | 3/1988 | Davidson et al. | 364/424 |
| 4,738,377 | 4/1988 | Demoss, Jr. | 222/1 |
| 4,807,131 | 2/1989 | Clegg | 364/424.01 |
| 5,035,290 | 7/1991 | Harms et al. | 172/1 |
| 5,044,446 | 9/1991 | Jonasson et al. | 172/4.5 |
| 5,065,019 | 11/1991 | Darilek et al. | 250/301 |
| 5,113,192 | 5/1992 | Thomas | 342/22 |
| 5,197,783 | 3/1993 | Theimer et al. | 299/17 |
| 5,235,511 | 8/1993 | Middleton et al. | 364/424.07 |
| 5,327,345 | 7/1994 | Nielsen et al. | 364/424.07 |
| 5,357,063 | 10/1994 | House et al. | 181/108 |
| 5,357,253 | 10/1994 | Van Etten et al. | 342/22 |
| 5,365,442 | 11/1994 | Schmidt | 364/424.07 |
| 5,370,478 | 12/1994 | Bartlett et al. | 405/128 |
| 5,410,252 | 4/1995 | Potter et al. | 324/345 |

*Primary Examiner*—Terry Lee Melius
*Assistant Examiner*—Victor Batson
*Attorney, Agent, or Firm*—James R. Yee; Steven G. Kibby

[57] ABSTRACT

An apparatus coupled to a work machine for assisting the work machine in removing a first layer of material from a second layer of material is provided. The work machine includes a work implement with a cutting portion. The work implement is elevationally movably connected to the work machine. The cutting portion extends in a direction transverse the longitudinal axis of the work machine. An electromagnetic unit, connected to the work machine, delivers electromagnetic radiation towards the surface, receives a reflection of the delivered electromagnetic radiation, and delivers a responsive first signal. The electromagnetic radiation penetrates the first layer of material and reflects off of the second layer of material. A controller receives the first signal, determines the distance between the electromagnetic unit and the second layer of material and responsively produces a distance signal. An implement controller receives the distance signal and responsively actuates the work implement relative to the frame.

11 Claims, 5 Drawing Sheets

IMPLEMENT CONTROL SYSTEM FOR LOCATING A SURFACE INTERFACE AND REMOVING A LAYER OF MATERIAL

TECHNICAL FIELD

This invention relates to a work implement control system and more particularly to a system for controlling a work implement during removal of a layer of material.

BACKGROUND ART

One problem in earthmoving operations is encountered when a layer of one material must be removed from another layer of material.

First, the exact location of the interface between the two materials is unknown. This makes removal of the material a laborious process since the operator may need to make multiple passes over the site with an earthmoving machine. Conversely, the operator may dig too deep and remove some of the second layer.

If the first material is snow and/or ice another problem is encountered. In order to remove as much snow as possible, the blade of the earthmoving machine must be as close as possible to the pavement as possible. Frequently, the blade is overextended which both increases wear on the blade, but also reduces the life of the underlying pavement.

The present invention is directed to overcoming one or more of the problems set forth above.

DISCLOSURE OF THE INVENTION

In one aspect of the present invention, an apparatus coupled to a work machine for assisting the work machine in removing a first layer of material from a second layer of material is provided. The work machine includes a work implement with a cutting portion. The work implement is elevationally movably connected to the work machine. The cutting portion extends in a direction transverse the longitudinal axis of the work machine. An electromagnetic unit, connected to the work machine, delivers electromagnetic radiation towards the surface, receives a reflection of the delivered electromagnetic radiation, and delivers a responsive first signal. The electromagnetic radiation penetrates the first layer of material and reflects off the second layer of material. A controller receives the first signal, determines the distance between the electromagnetic unit and the second layer of material and responsively produces a distance signal. An implement controller receives the distance signal and responsively actuates the work implement relative to the frame.

BEST MODE FOR CARRYING OUT THE INVENTION

Figure 1:
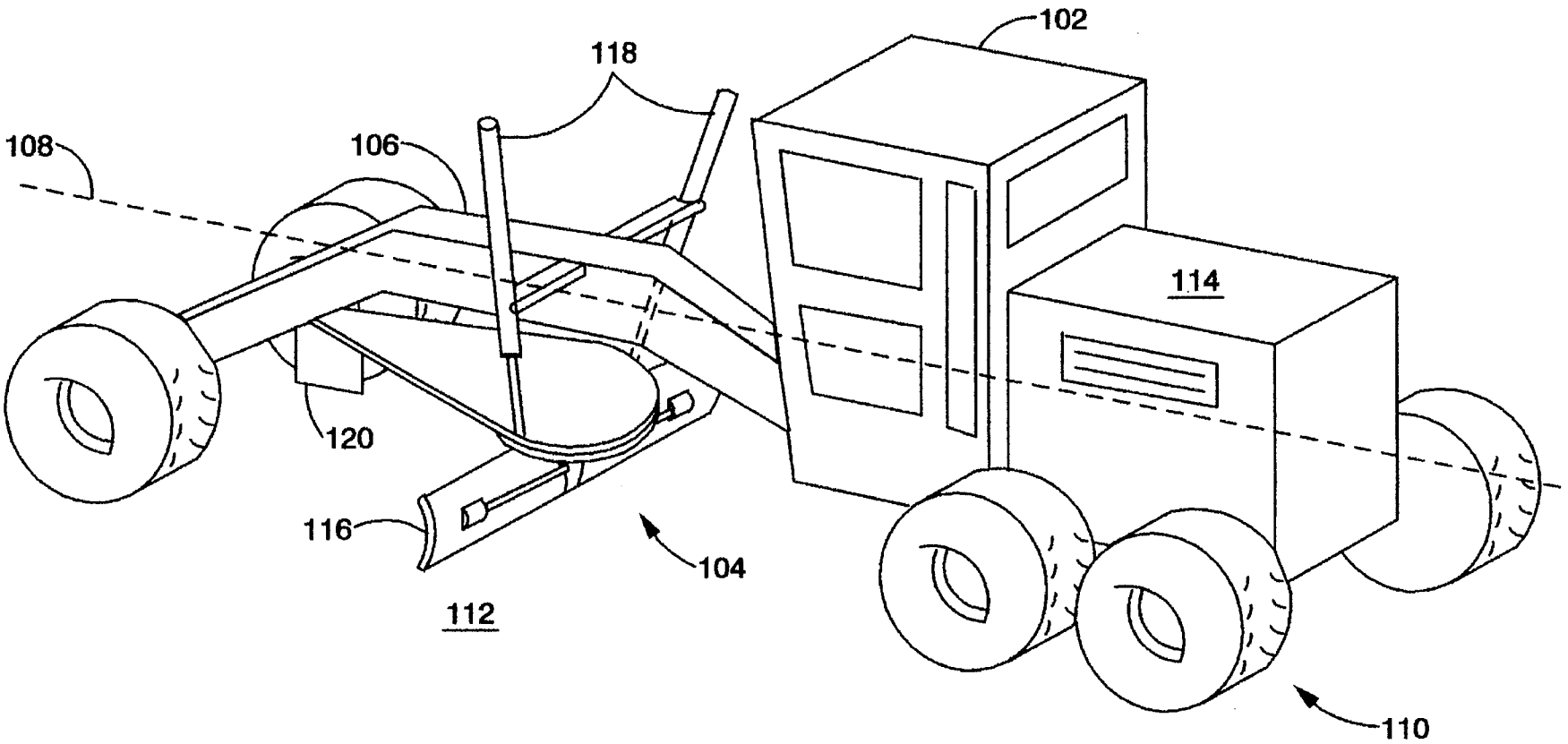
FIG. 1 is a diagrammatic view of a work machine having an implement control system for snow removal.

With reference to the drawings, the present invention provides a system 202 for controlling a work implement 104 elevationally movably connected to a work machine 102. The present invention is especially adapted for removing a first layer of material 112A from a second layer of material 112B, for example, snow and ice removal from a parking lot or road. In this example, snow and ice constitute the first layer 112A and the parking lot or road constitutes the second layer 112B. In the discussion below, the present invention is discussed in terms of snow and ice removal, however, the present invention is not limited to such.

The particular work machine 102 shown is a motor grader, however, it is to be noted that other work machines, for example, a dozer, a scraper, and the like are equivalents and within the scope of this invention.

The work machine 102 has a frame 106 of any suitable design, a longitudinal axis 108 extending the length of the frame 106, and a plurality of rotatable members 110 connected to the frame 106 at opposite end portions of the frame 106. The rotatable members 110 are shown as wheels, however, crawler track and other suitable rotatable ground engaging members are considered equivalents and within the spirit of the invention. The rotatable members support the frame 106 on a geographic surface 112.

A prime mover 114, such as an internal combustion engine, is mounted on the frame 106 and drivingly connected to the plurality of rotatable members 110 in any suitable and conventional manner, such as by a mechanical, fluid, or hydrostatic transmission (not shown). The prime mover 114 rotates the rotatable members 110 and propels the work machine over the underlying geographic surface 112.

The work implement 104 has a cutting portion 116 and is elevationally movably connected to the frame. A pair of spaced lift jacks 118 connected to the work implement 104 elevationally moves the work implement 104 relative to the frame 106.

The lift jacks 118 are connected to and between the frame 106 and the work implement 104 at transversely spaced apart locations on the frame 106 relative to the longitudinal axis 108. The jacks 118 are fluid operated, telescopic, and actuatable to elevationally move the work implement 104 relative to the frame 106. As shown, the lift jacks 118 are movable between a first position at which the rods of the jacks 118 are retracted and the work implement 104 is elevationally raised toward the frame 106 and a second position at which the rods are extended and the work implement 104 is elevationally lowered away from the frame 106.

Figure 2:
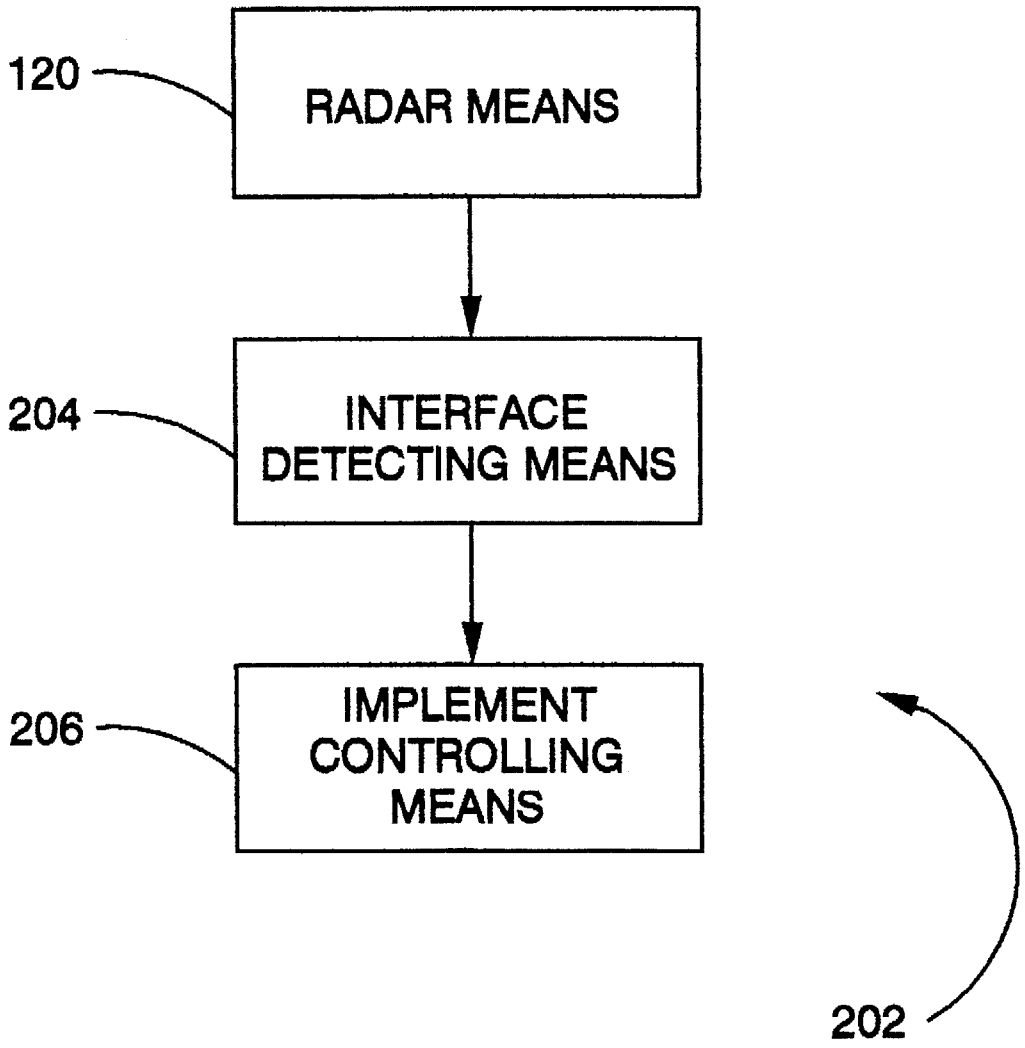
FIG. 2 is a block diagram of the control system of FIG. 1.
Figure 3:
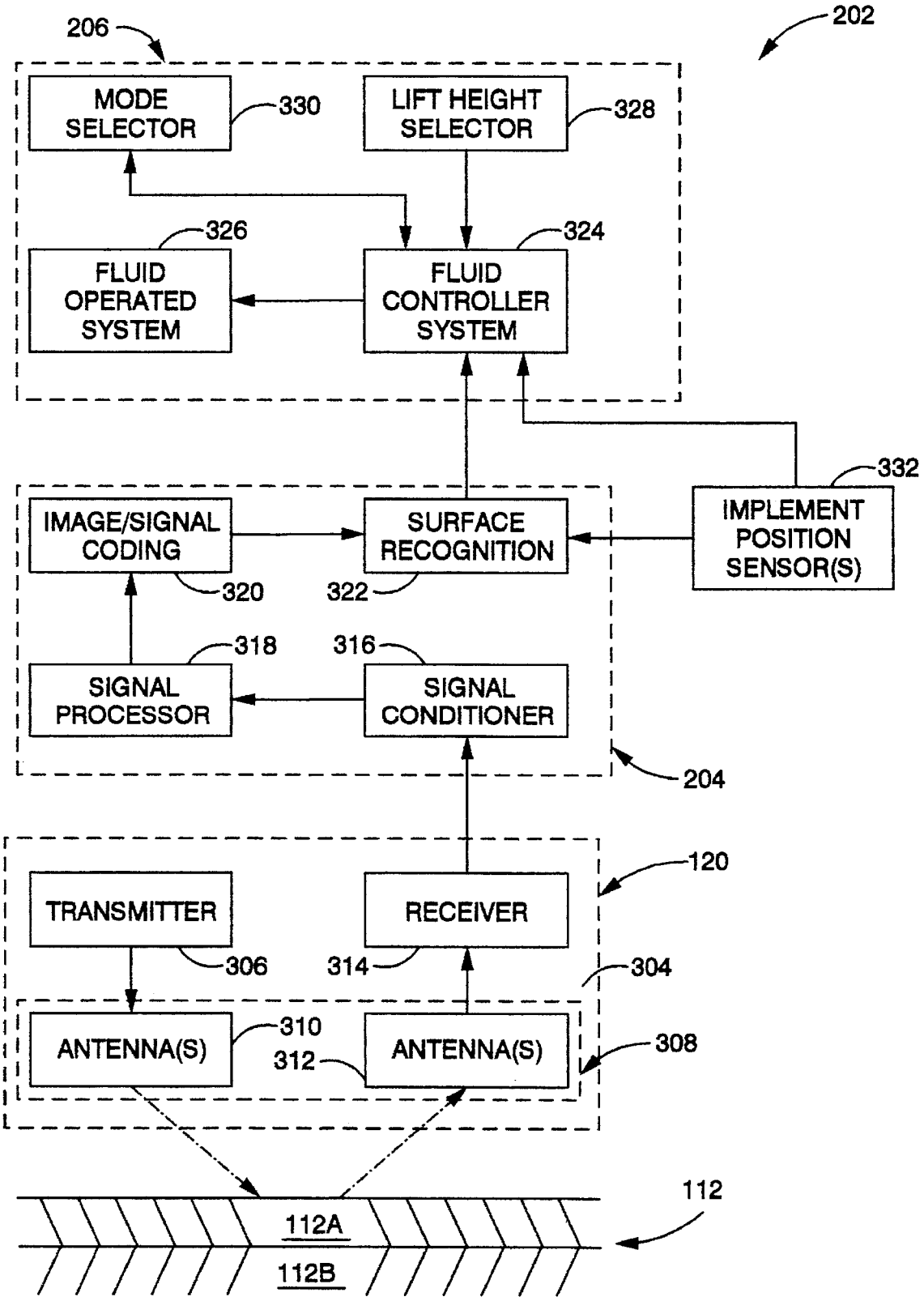
FIG. 3 is a more detailed block diagram of the control system of FIG. 1, according to an embodiment of the present invention.

As seen in FIGS. 1,2, and 3, an electromagnetic means 120 is provided for delivering electromagnetic radiation, receiving a reflection of the delivered electromagnetic radiation, and delivering a responsive first signal. The electromagnetic means 120 is mounted at a preselected location on the frame 106 spaced from the geographic surface 112. The electromagnetic means 120 is oriented to deliver electromagnetic radiation toward the underlying geographic surface 112 and penetrate the snow and ice 112A. Penetration is controlled by, for example, the intensity or the frequency of the electromagnetic radiation signal produced by the electromagnetic means 120. Thus, the frequency of the electromagnetic radiation delivered by the electromagnetic means 120 is selected to allow penetration of snow and ice 112A and to reflect off of the second layer 112B.

With reference to FIGS. 1,2 and particularly FIG. 3, the electromagnetic means 120 includes a electromagnetic unit 304 of the land borne type. The electromagnetic unit 304 has a transmitter 306, and a single antenna 308 or an array of antennas 308. Each antenna 308 has an emitting coil 310 connected to the transmitter 306 and a receiving coil 312 connected to a receiver 314.

The emitting coil 310, based on the signal delivered from the transmitter 306, delivers primary electromagnetic energy and the receiving coil 312 receives secondary electromagnetic energy (returned) from the underlying surface 112 and delivers it to the receiver 314. The receiver 314 receives the secondary electromagnetic energy, amplifies the weak energy waves and delivers a responsive first signal, an analog signal. The number of antennas 308 provided in the array used is a function of the effective length of the work implement 104 which equates to the width of the path that the work machine 102 must traverse and the field of coverage of each antenna 308. The antennas are arranged to extend transversely across the frame 106 relative to the longitudinal axis 108. The preferred antenna 308 is a folded dipole antenna. Alternatively, the antenna(s) may send and receive signals from the same coil by controlling the timing of the transmitted and received signals. Such technology is known to those skilled in the art and considered within the scope of the invention.

It is to be noted that an array of antennas 308 may be replaced by a single antenna 308 which is swept or moved across the frame transversely relative to the longitudinal axis 108.

The electromagnetic means 120 may also include a hybrid system which combines electromagnetic unit 304 with other sensing devices without departing from the invention. For example, metal detectors, magnetometers and other electromagnetic devices may be utilized to improve the accuracy of detection. Such a combination is considered well known to those skilled in the art and will therefore not be discussed in any greater detail.

A interface detecting means 204 is connected to the electromagnetic means 120 and receives the first signal delivered by the receiver 314. The interface detecting means 204 preferably includes a computer having a processor and memory. Any commercially available computer is suitable. However, it is to be noted that a processor composed of discrete components arranged to perform the required functions is considered equivalent and within the scope of the invention.

The interface detecting means 204 determines the location of the interface between the two layers 112A, 112B, i.e., the distance from the electromagnetic means 112 to the interface, and delivers a responsive location indicative of the distance.

A signal conditioner 316 is connected to the receiver 314 and receives the first signal. The signal conditioner 316 is essentially a filter which improves the signal-to noise ratio of the analog first signal in a well known manner. The interface detecting means 204 also includes a signal processor 318 connected to the signal conditioner 316. The signal processor 318 digitizes the filtered analog first signal and performs other computations to convert the first signal to a more usable format.

Figure 4:
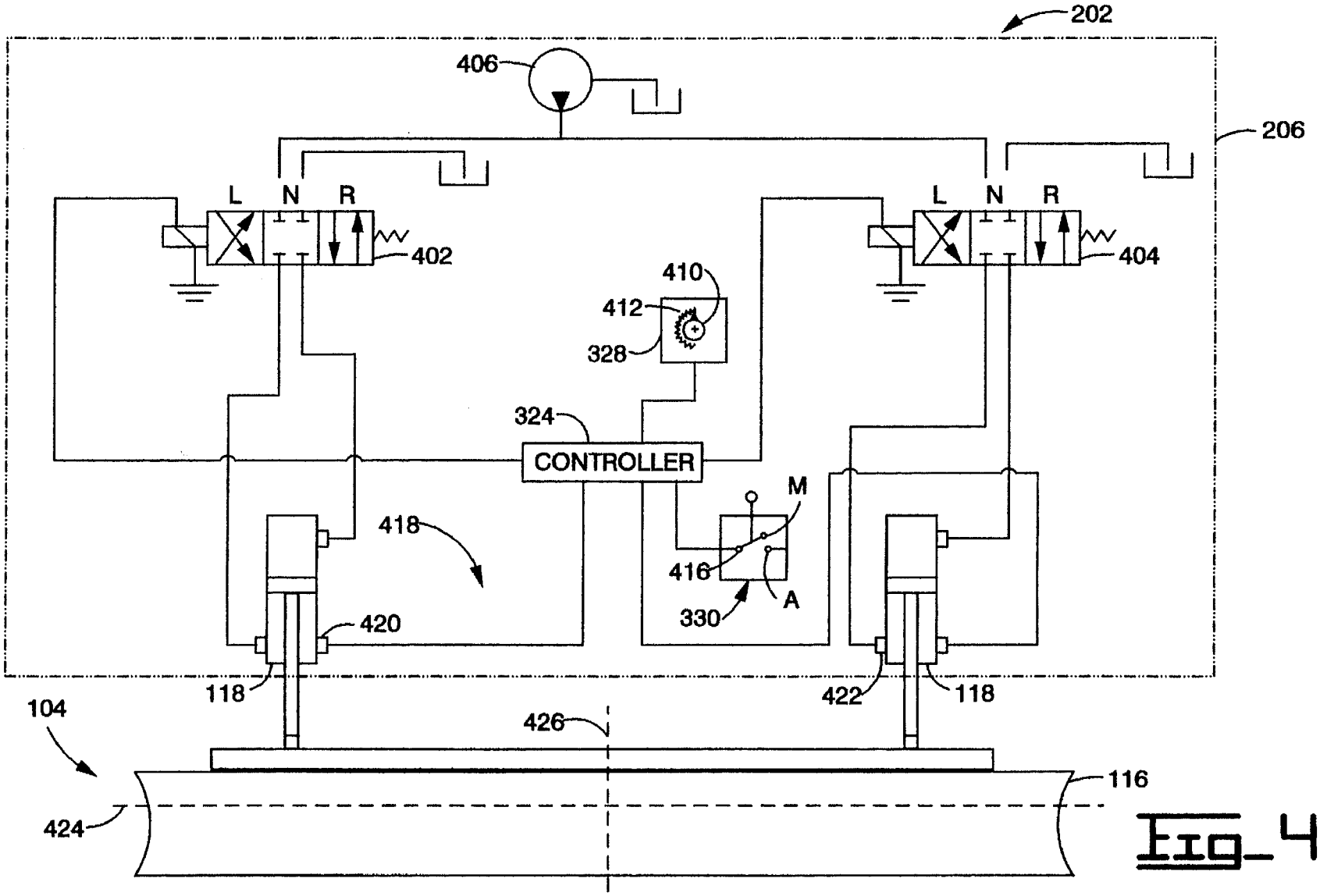
FIG. 4 is a diagrammatic schematic representation showing the implement control system of FIG. 3 in greater detail.

The converted first signal is processed further by signal/image coding software 320 which looks for predetermined conditions in the processed data that corresponds to the surface 112. The interface detection system 204 also includes surface recognition software 322 that further processes the information to determine the locations and/or distance to the interface and produces a distance signal As best seen in FIGS. 3 and 4, an implement control means 206 is connected to the interface detecting means 204 and provided for elevationally controlling movement of the work implement 104 in response to signals from the interface detecting means 204. In particular, the implement control means 206 automatically positions the work implement 104 relative to the surface 112 in response to receiving the distance signal from the interface detecting means 204.

The implement control means 206 includes a controller 324 connected to a fluid operated system 326. The controller 324 delivers electrical control signals to the fluid operated system 326 in response to receiving input signals from a variety of devices, including the interface detecting means 204. The controller 324 includes a driver circuit of conventional design (not shown) and a signal processor of any appropriate type.

In the preferred embodiment, the fluid operating system 326 includes first and second electrohydraulic control valves 402,404. The first and second control valves control actuation of respective hydraulic cylinders to effectuate movement of the work implement 104. Both control valves and hydraulic cylinders 118 operate in a similar manner, therefore, only one will be discussed. The first electrohydraulic control valve 402 has a first "R" and second "L" positions and a neutral position "N". The first electrohydraulic control valve 402 is connected to and between a pump 406 and the respective hydraulic cylinder 118 and delivers fluid flow from the pump 406 to the hydraulic cylinder 118 at the "R" and "L" positions and prevents fluid flow from being delivered to the hydraulic cylinder 118 at the neutral position. The hydraulic cylinder 118 extends and lowers one side of the work implement 104 when the first electrohydraulic control valve 402 is at the "L" position and retracts and raises the work implement 104 when the first electrohydraulic control valve 402 is at the "R" position. The first electrohydraulic control valve 402 is shiftable between the "R" and "L" positions in response to signals delivered from the controller 324.

The implement control means 206 also includes a distance selector means 328. The distance selector means 328 is provided for selecting a target distance between the cutting edge of the work implement 104 and the interface and responsively delivering a target distance signal. The distance selector means 328 includes a dial indicator 410 having a potentiometer 412. The dial indicator 410 is operated by the operation. The signal delivered is analog and sets the desired distance between the cutting blade 116 and the interface 112. It is to be noted that a digital selecting device such as an encoder or any other suitable device for inputting information is a suitable replacement and within the scope of the invention. The distance selector means 328 is connected to the controller 324 and delivers the target distance thereto.

The implement control means 206 further includes a mode selector means 330 connected to the controller 324. Preferably, the mode selector means 330 includes a switch 416 having an automatic mode position "A" and a manual mode position "M" and being selectively manually movable therebetween. The switch 416 at the automatic mode position "A" delivers an automatic mode signal to the controller 324 to enable automatic operation of the fluid operated system 326 and at the manual mode position "M" delivers a manual mode signal to the controller 324 so that only manual positioning of the work implement 324 is permissible.

The controller 324, based on preprogrammed instructions, responds to the manual "M" and automatic "A" signals and delivers only the appropriate ones of the automatic and manual control related signals. Automatic positioning of the work implement based on detection of the distance to the surface 111 is only possible in the automatic mode of operation.

Operation of the work machine 102 in the manual mode is effectuated via a series of control levers (not shown) in a known manner.

An implement position sensor means 332 senses the elevational position of the cutting portion 116 of the work implement 104 relative to the frame 106 and delivers responsive elevational position signals. In the preferred embodiment, the implement position sensor means 332 includes first and second elevational sensors 422, 420 for sensing the positions of each side of the cutting blade 116, respectively. The sensors 422, 420 are connected to the surface detection means 204 and adapted to deliver position signals to the object detection means 204 and the implement control means 206.

The implement position sensors 422, 420 are connected to the respective hydraulic cylinder 118 and sense the amount of extension of the respective hydraulic cylinder 118.

Given the known geometry and dimensions of the work implement 104, the position of the cutting portion 116 relative to the frame 106 is easily determined. This position information is utilized by the surface detection means 204 and the implement control means 206 during the processing of the various signals and for purposes of comparison and calculations. The implement position sensor means 332 includes any one of the many well known types of linear transducers. For example, a yoyo, an encoder, an LVDT, a RF sensor and the like.

Additionally, the implement control means 206 may include means for rotating the cutting blade 116 about first and second axes 424, 426. This movement is effectuated via additional hydraulic cylinders (not shown) and valves (not shown). Additional sensors may be included to compensate for movement about the axes 424, 426.

The implement control means 206 may also be utilized to control the blade so as to not hit an obstacle detected by the electromagnetic means 120, e.g, manhole covers.

Industrial Applicability

Figure 5:
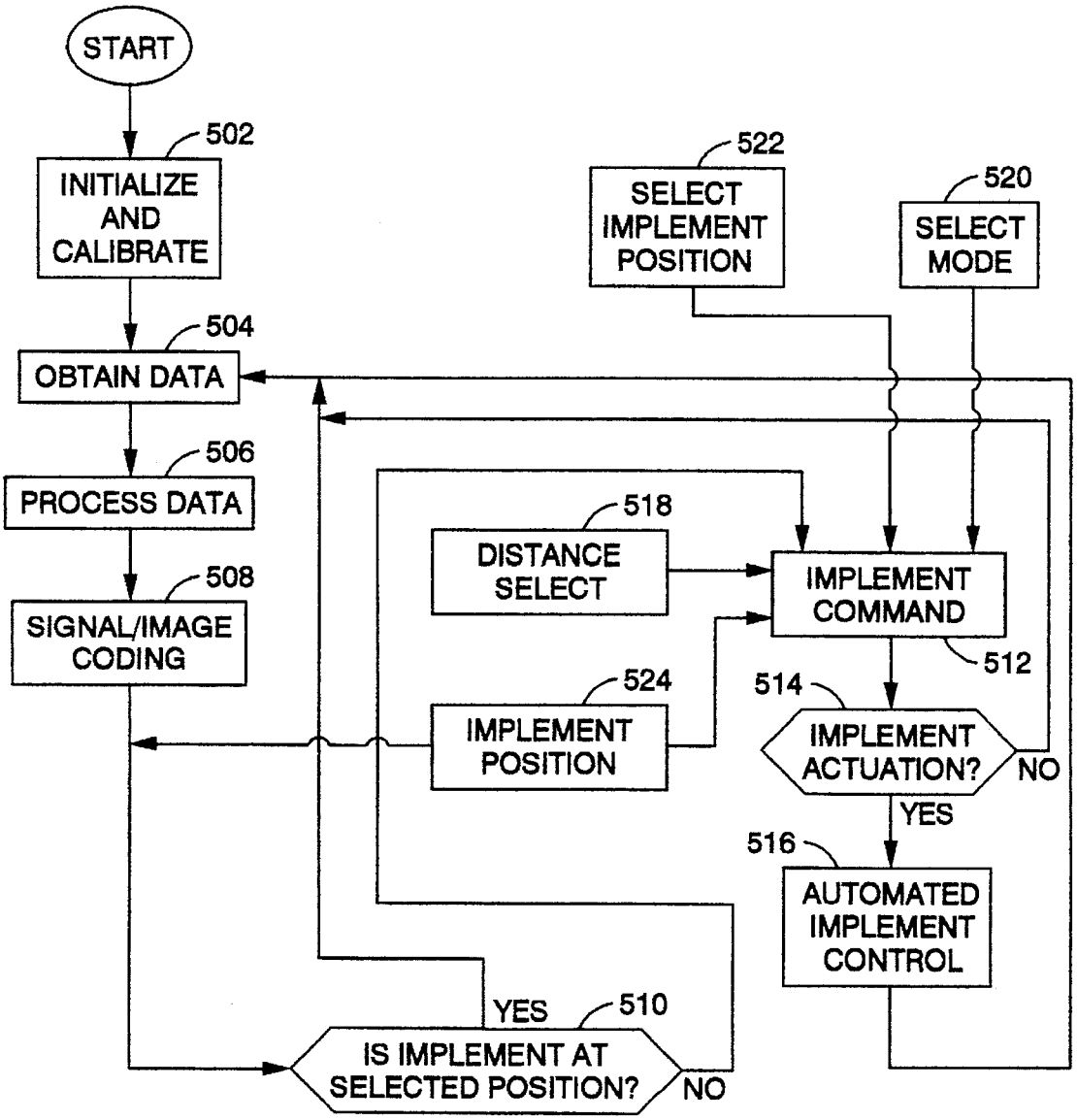
FIG. 5 is a flow chart disclosing the logic associated with the inplement control system.

In operation and with reference to the drawings, particularly FIG. 5, the logic associated with automatic object responsive control of the work implement 104 of the work machine 102 as carried out by the hardware and software of the electromagnetic means 120, interface detecting means 204, and implement control means 206 is disclosed in substantial detail. In order to operate the automatic object responsive control system 202 the work machine operator must first initialize and calibrate the system.

In a first control block 502, initialization and calibration is achieved for example, by switching the electrical system mode selector means 330 to the automatic mode "A" and by adjusting the electromagnetic means 120 to a desired depth of penetration. Adjustments of this type are a function of the particular electromagnetic means 120 used. Such adjustments compensate for different surface types, moisture and other conditions that affect the accuracy of operation. This calibration usually involves adjusting the frequency of the signal delivered toward the underlying surface 112. Such calibration is well known to those skilled in the operation of electromagnetic unit and the like and will therefor not be discussed in any greater detail.

In second, third, and fourth control blocks 504, 506, 508, surface processing which includes coding, identifying and locating. In the second control block 504, the ground returned first signal delivered from the electromagnetic means 120 is amplified, converted to processable strings of gray scales and recorded for further processing. In the third control block 506, the data is further processed. This includes digitizing the first signal and converting the data to a more usable format. In the fourth control block 508, the converted first signal is processed further by signal/image coding software 320. This software looks for anomalies in the processed data that corresponds to the surface 112.

In a first decision block 510, the elevational position of the work implement 104 is compared with the selected target distance. If the work implement 104 is positioned the correct distance from the surface 112, control returns to the second control block 504.

The implement commands carried out by the implement control means 206, as previously discussed, are associated with and indicated in a fifth control block 512, a second decision block 514, and a sixth control block 516. The selected distance (control block 518) and selected mode (control block 520) signals from the various devices discussed above are delivered to the implement command box 120. The implement control means 206 processes these signals and the signals delivered from the interface detecting means 204 and controls the position of the work implement 104 based on the signals and preprogrammed instruction.

In the second decision block 514, automatic implement actuation takes place when certain conditions are met. If the selected mode is manual, automatic implement actuation will not take place. The implement controller 324 enables automatic implement 104 positioning only when an automatic mode signal is received.

Information from the implement control means 206, such as the selected implement position and the selected lift height is fed back to update the data recorded in the interface detecting means 204. This information is utilized during subsequent automatic implement positioning.

Other aspects, objects and advantages of the present invention can be obtained from a study of the drawings, the disclosure and the appended claims.

We claim:

1. An apparatus coupled to a work machine to assist the work machine in removing a first layer of material from a second layer of material, the work machine having a frame, comprising:

a work implement having a cutting portion and being elevationally movably connected to the work machine, said cutting portion extending in a direction transverse to a longitudinal axis of the work machine;

electromagnetic means, mounted to the work machine, for delivering electromagnetic radiation to penetrate the first layer of material, receiving a reflection of said delivered electromagnetic radiation from said second layer of material, and generating a responsive first signal;

interface detecting means for receiving said first signal, determining the distance between said electromagnetic means and the second layer of material and responsively producing a distance signal; and implement control means for receiving said distance signal and responsively controlling the position of said work implement relative to said frame.

2. An apparatus, as set forth in claim 1, wherein said electromagnetic means controls the penetration of said first layer of material by said electromagnetic radiation by varying at least one of an intensity and a frequency of said electromagnetic radiation.

3. An apparatus, as set forth in claim 2, wherein:

said electromagnetic means delivers said radiation at a frequency selected to substantially penetrate a material forming said first layer and reflect from a material forming said second layer, and said interface detecting means responsively produces said distance signal by detecting the interface between said first and said second materials.

4. An apparatus, as set forth in claim 1, wherein said interface detecting means responsively delivers said distance signal by detecting anomalies in said first signal indicative of an interface between said first and said second layers of material.

5. An apparatus, as set forth in claim 4, said implement control means further comprising distance selector means for selecting a target distance between the cutting edge of the work implement and the interface, said implement control means responsively maintaining said target distance.

6. An apparatus, as set forth in claim 5, further comprising:

implement position sensor means responsively delivering elevational position signals indicative of the position of the cutting portion of the work implement relative to the frame, said implement control means maintaining said target distance by comparison of said distance signals, elevational position signals and said target distance.

7. An apparatus, as set forth in claim 1, wherein said electromagnetic means comprises at least one transmitter, receiver, and antenna.

8. An apparatus, as set forth in claim 7, wherein said at least one antenna comprises an emitting coil connected to said transmitter and a receiving coil connected to a receiver.

9. An apparatus, as set forth in claim 7, wherein said at least one antenna comprises a coil alternately emitting and receiving said electromagnetic radiation.

10. An apparatus, as set forth in claim 7, wherein said at least one antenna is moved across said frame transversely relative to said longitudinal axis.

11. An apparatus, as set forth in claim 1, said electromagnetic means comprising a plurality of antennas arranged to extend traversely across said frame relative to said longitudinal axis, the number of said antennas determined as a function of a length of said work implement.

* * * * *